United States Patent [19]

Cudby et al.

[11] 4,176,769

[45] Dec. 4, 1979

[54] FLUTED,-STEPPED, POUR NOZZLE

[75] Inventors: Joseph W. Cudby, Sheffield, England; Christopher F. King; Nicholas Syred, both of Cardiff, Wales

[73] Assignee: USS Engineers and Consultants, Inc., Pittsburgh, Pa.

[21] Appl. No.: 888,904

[22] Filed: Mar. 22, 1978

[30] Foreign Application Priority Data

Apr. 7, 1977 [GB] United Kingdom ..... 14724/77

[51] Int. Cl.[2] ..... B22D 41/08

[52] U.S. Cl. ..... 222/591; 239/590.5

[58] Field of Search ..... 164/437; 222/590, 591, 222/598, 600, 564, 566, 567; 239/590.5

[56] References Cited

U.S. PATENT DOCUMENTS

| | | | |
|---|---|---|---|
| 3,253,307 | 5/1966 | Griffiths et al. | 222/591 X |
| 3,841,539 | 10/1974 | Shapland, Jr. et al. | 222/600 |
| 4,003,561 | 1/1977 | Cudby | 222/600 |

FOREIGN PATENT DOCUMENTS

| | | | |
|---|---|---|---|
| 1159118 | 7/1969 | United Kingdom | 222/591 |
| 180308 | 4/1966 | U.S.S.R. | 222/591 |
| 444603 | 6/1975 | U.S.S.R. | 222/591 |

*Primary Examiner*—David A. Scherbel
*Attorney, Agent, or Firm*—John F. Carney

[57] ABSTRACT

Flaring, splashing and spitting of the molten metal flow stream issuing from a flow control nozzle of the type forming the collector nozzle of a sliding plate valve is prevented by forming the flow passage through the nozzle with a flow-impeding constriction intermediate the ends thereof. The passage is also provided with a duct section downstream of the constriction and includes means for preventing recirculatory currents in the flow stream from entering and passing the constriction.

13 Claims, 9 Drawing Figures

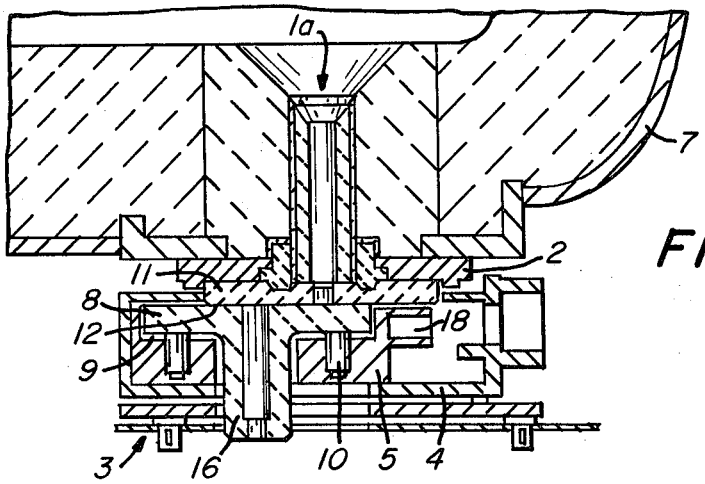
FIG. 1
FIG. 2
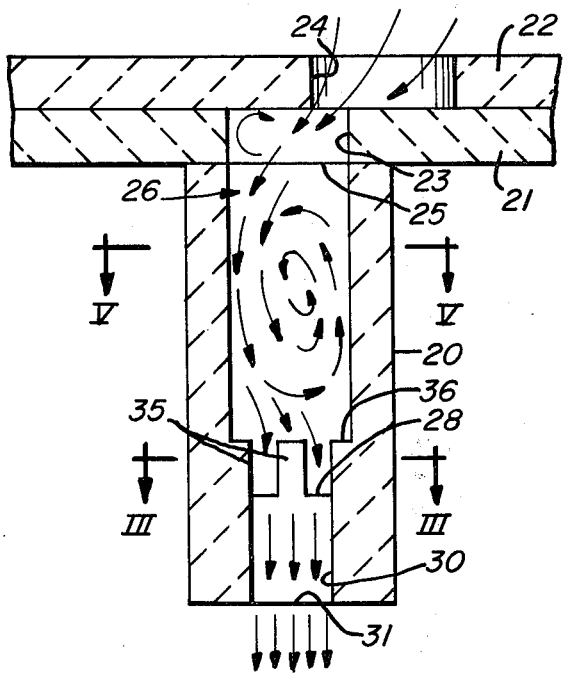
FIG. 4
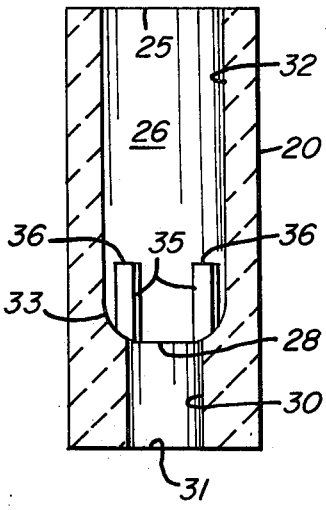
FIG. 3
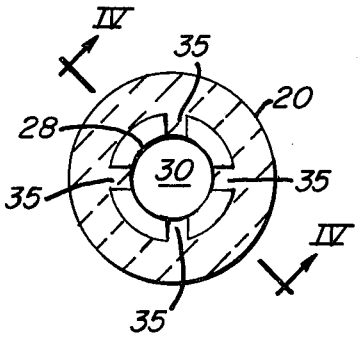
FIG. 5
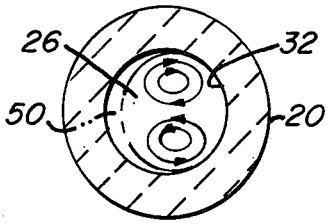
FIG. 6
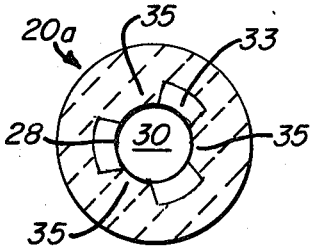

FLUTED,-STEPPED, POUR NOZZLE

The present invention relates to fluid jet nozzles, and more particularly but not exclusively to nozzles for use in sliding plate valves for controlling molten metal flow from one vessel to another.

The instability of an inviscid jet issuing from a nozzle is well known. Instability promoting break up of the jet is thought to be caused by one or more of several factors. Firstly, minute disturbances in the jet surface immediately downstream of the nozzle exit can grow rapidly and when the disturbances reach a size comparable to the jet radius, break up occurs. Secondly, it is well known that the viscosity of a fluid flowing in a passage is non-uniform, even if laminar flow conditions prevail. Upon emerging from a nozzle, a redistribution of energy takes place inside the jet accompanied by velocity changes towards a more uniform condition. Energy redistribution can be sudden and can lead to a jet bursting. If the fluid flow is turbulent rather than laminar in the nozzle passage, these two effects are more pronounced. Under some conditions, a third phenomenon is observed, namely at atomisation. If, for example, non-linear flow occurs in the nozzle passage, air may be drawn into the passage and promote jet break up by atomisation.

In metal casting practice, where molten metal is teemed e.g. into an ingot mould through a nozzle, substantial instability is often noted. Flaring, splashing and "atomisation" commonly occur. Apart from being potentially hazardous, ill-defined jets are highly undesirable. Splashing can lead to inhomogenous solidification, and jet break up or atomisation causes detrimental mixing of the molten metal with air and can result in undesirable oxidation of the metal.

Jet instability can become particularly troublesome when controlling the teeming of molten metal by means of a sliding plate valve. It appears that when the valve is in a partially open setting, the asymmetric entry of molten metal into the valve discharge nozzle, the so-called "collector" nozzle, is largely responsible for creating turbulence and instability. The aim of the present invention is to provide improved nozzles suitable, inter alia, for use with sliding plate valves.

According to the present invention, there is provided a nozzle suitable for use in a sliding plate valve, comprising a hollow body having, in its interior, an inlet passage leading from an inlet opening to a flow-impeding constriction at the entrance to a duct leading to an outlet opening, the said inlet passage being shaped to provide means for preventing recirculatory currents in fluid upstream of the constriction from entering and passing the constriction, and means for eliminating swirling of the fluid before passage through the constriction.

The invention also provides a nozzle suitable for use in a sliding plate valve, comprising a hollow body having, in its interior, an inlet passage leading from an inlet opening to a flow-impeding constriction at the entrance to a duct leading to an outlet opening, the body inner wall defining the inlet passage being shaped to present, upstream of the constriction, a bluff obstruction to fluid flow for preventing recirculatory currents from entering and passing the constriction, the said wall also being shaped to define a plurality of inwardly-projecting anti-swirl fins or ribs upstream of the constriction.

Generally, the duct downstream of the constriction has the same dimensions as the constriction itself. Thus, with the aim of obtaining optimum results in terms of a well-defined compact jet from the nozzle, the preferred embodiment has a parallel-sided duct. The duct could be convergent downwardly of the constriction, the side walls thereof being inclined by up to 15° with respect to a central longitudinal axis through the duct. Alternatively, the duct could be downwardly divergent, its side walls being inclined by up to 3½° to the said axis.

The flow-impeding constriction can take various forms. Thus, it could simply be constituted by the junction between the upstream end of the duct and an internal shoulder extending around the interior of the hollow body. The presence of a shoulder, lying in a plane normal to the general direction of flow through the inlet passage towards the duct, would present an abrupt change in flow cross section, however. It may be preferable, therefore, for the constriction to form a gradual transition between the inlet passage and the duct. Accordingly, the constriction can be frusto-conically shaped.

Preferably, however, the shape of the constriction corresponds to the gradually-incurving form of a fire-hose nozzle. The inwardly-curving constriction whereby the inlet passage merges with the entry to the duct can be of any convenient geometrical form such as part-spherical or parabolic.

The means for countering the recirculatory currents preferably consist of one or more inwardly-directed steps projecting from the inner wall of the hollow nozzle body. The said step or steps can be normal to the general direction of flow through the inlet passage towards the duct. The or each step optionally forms a continuously-extending ledge around the inlet passage.

The anti-swirling means can be three, four, or more inwardly-projecting fins or ribs which extend parallel to the general direction of flow through the inlet passage towards the duct. Conveniently, the fins or ribs are evenly spaced about the inner wall of the hollow body. The fins or ribs extend upstream from the entry to the duct to such a location that they create a minimum of interference with the correct functioning of the means for countering recirculatory currents. Accordingly, the fins or ribs should extend only part-way along the inlet passage and desirably they do not extend upstream beyond the said means for countering recirculatory currents.

Advantageously, the upstream ends of the fins or ribs form bluff, inwardly-projecting steps on the inner wall of the hollow body. Their upstream ends can thereby serve as the means for countering the recirculatory currents.

The hollow body of the nozzle should be made from an erosion and heat resisting refractory material when the nozzle is for use in the teeming of molten metals.

Whilst primarily intended for use as a sliding plate valve discharge nozzle, the present nozzle could be used as a pour nozzle in a vessel such as a bottom-pour ladle or tundish. If intended to co-operate with a stopper rod, the inlet opening should be shaped in a known way for seating the end of the rod.

When a preferred embodiment is applied to a sliding plate valve, tests show that extremely satisfactory jet characteristics are attainable, even when the valve is in an extreme flow-throttling setting. For example, when a sliding plate valve fitted with a conventional, plain-bored collector nozzle is only 60% open or less, break up of the flowing stream can even occur inside the nozzle, and unacceptably intense mixing with entrained air often takes place. By contrast, a compact, well-defined jet can be attained with the present nozzle even for valve settings as low as 5% of its fully open setting. Moreover, it has just been mentioned that break up can commence inside a conventional nozzle. With the nozzle embodying the invention, break up may not occur until a point is reached downstream of the nozzle outlet a distance in excess of at least five times the issuing jet diameter. In some instances, the said distance can be as high as ten or even twenty times the said diameter. Relatively long, unbroken jets of molten steel can be expected to issue from nozzles according to the invention, therefore.

One of the anticipated advantages of the present nozzles when applied to sliding plate valves is the role played by the constriction. It appears that the constriction keeps the nozzle upstream thereof flooded and generates a back-pressure in the upstream flow path capable of overcoming any tendency for air to be sucked into the flow stream via the interface region of the valve plates.

The benefits of the present nozzles are expected to be felt most towards the end of a teem, when metallostatic pressure heads are comparatively low. As is well known, contact between a molten metal stream and a refractory nozzle causes erosion of the nozzle. Erosion is most likely to take place during the early stages of a teem, however. To protect the bluff-ended anti-swirl fins or ribs of the preferred embodiment against prematurely wearing away, it is suggested that they be embedded in a relatively soft, erodable nozzle lining of refractory material which will gradually wear away during the early teeming stages. The said lining can coact with the inner wall of the nozzle body to define a stepped flow passage having a large upstream section and a smaller downstream section. The nozzle lining can have a bore dimensioned to form an upstream continuation of the duct.

A region of conventional collector nozzles which is particularly prone to erosion damage is at the discharge outlet. A worn-ended nozzle can aid dispersion of the jet owing to the tendency of the flowing stream to adhere to the nozzle internal walls. With the aim of overcoming this problem, the present nozzles can be provided with means for establishing an enveloping curtain of an inert gas between the walls of the duct and the molten metal. The presence of such a curtain is beneficial for two reasons: firstly it minimises erosion and secondly it helps to prevent bugging, skulling or snottering of the nozzle outlet duct. Bugging, skulling or snottering are problems commonly encountered particularly when aluminum-killed steels are being teemed through alumina nozzles.

The present invention comprehends sliding plate valves equipped with nozzles in accordance with the invention, as well as vessels fitted with such valves. Two or three plate valves are embraced by the invention, and can be of the reciprocating, rotating or shove-through types.

The invention will now be described in more detail by way of example only with reference to the accompanying drawings, in which:

FIG. 1 is a fragmentary sectional view through a ladle and sliding plate valve embodying the invention;

FIG. 2 is a longitudinal sectional view through the refractory plates of a two plate valve and through a nozzle embodying the invention, exemplified flow patterns being shown therein;

FIG. 3 is a cross-sectional view through the nozzle shown in FIG. 2, taken on line III—III of FIG. 2;

FIG. 4 is a longitudinal sectional view through the nozzle shown in FIGS. 2 and 3, taken on line IV—IV of FIG. 3;

FIG. 5 is a cross-sectional view through the nozzle shown in FIGS. 2 to 4, taken on line V—V of FIG. 3, and further illustrating exemplified flow patterns therein;

FIG. 6 is a cross-sectional view, similar to the FIG. 3 illustration, of a modified nozzle embodying the invention;

Figure 7:
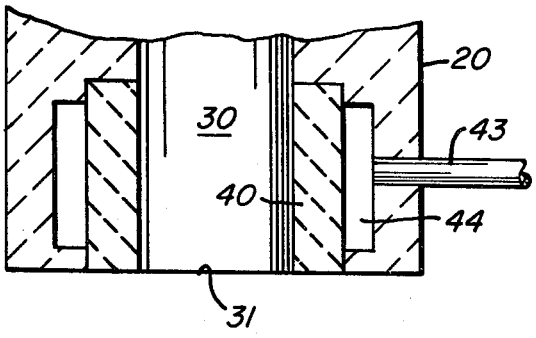
FIG. 7 is a fragmentary longitudinal sectional view illustrating means for generating a gaseous curtain between the nozzle wall and molten metal passing through the nozzle.

In FIG. 1 of the drawings part of a bottom-pour ladle 1 is shown, the ladle having a discharge well and nozzle assembly 1*a* providing a route along which molten metal can flow out of the ladle. A mounting plate 2 is secured to the bottom of the ladle and a slide plate valve 3 is affixed thereto. The valve 3 includes a slide frame 4 guidedly supporting a reciprocable slide 5. The slide 5 carries a slidable valve plate 8 which is urged upwardly by spring means 10 mounted in the slide 5 engaging the bottom of the pan 9. The spring means 10 bias the slide plate 8 into interfacial contact with a stationary valve plate 11, the confronting faces 12 of the plates 8 and 11 being flat and polished to form a liquid-tight slidable seal therebetween. Attached to the slide plate 8 and depending therefrom is a discharge or "collector" nozzle 16.

The valve 3 is shown closed (0% open) to metal flow from the ladle, flow orifices in the valve plates 8 and 11 being out of registry. By shifting the slide plate and nozzle 16 to the right until the said flow orifices are exactly in register, the valve is fully (100%) opened to metal flow from ladle 1 to a mould, not shown. If desired, the slide plate 8 can be moved to intermediate positions in which the said flow orifices overlap to a greater or lesser extent to open the valve partially to metal flow. Controlled movement of the slide plate 8 can be gained by means of a valve actuator such as a hydraulic ram which is coupled to the slide frame 4 and slide 5 by means indicated generally at 18.

A jet of metal issuing from a nozzle of conventional design tends to flare or break up and frequently is atomised and mixed with entrained air which can be drawn into the nozzle interior via one of two principal routes. Firstly, turbulence inside the nozzle may suck air upwardly through the nozzle discharge or exit opening. Secondly, metal streaming through the valve plate orifices into the nozzle may suck air between the confronting faces 12 into the orifice region. In any event, a poor quality jet is obtained from a conventional nozzle especially when the molten metal stream is severely throttled. So poor can the jet be that it may be unsafe to operate with the valve less than about 60% open.

A nozzle capable of producing relatively long, unbroken jets—even when the valve is in a severe flow-throttling setting e.g. when only 5 to 10% open—is shown in FIGS. 2 to 5.

In FIG. 2 nozzle 20 similar to the nozzle 16 of FIG. 1 is shown depending from the underside of a slide plate 21 which is in facial, sliding contact with a stationary plate 22. The exact nature of the joint between nozzle 20 and plate 21 is not part of this invention and no description thereof will be given. Suffice it to say that the joint should be air and liquid tight.

The nozzle 20 is a hollow refractory body made for example of high density alumina. The hollow interior of the nozzle 20 defines a flow passage for molten metal. Metal can enter the nozzle when the orifices 23, 24 of the valve plates 21, 22 are either in registry (valve 100% open), or in overlapping relationship as shown (valve partly open).

Nozzle 20 has an inlet opening 25 at one end of an inlet passage 26 which leads to a constriction 28. Constriction 28 is at the entry to a parallel-sided duct 30 which leads to an outlet opening 31 at the bottom exit end of the nozzle. As shown in FIGS. 3 and 5, the constriction 28, the duct 30 and a nozzle internal wall 32 defining inlet passage 26 are all of circular cross-section on a common centre. In this instance, the constriction 28 has the same diameter as the duct 30. As intimated hereinbefore, duct 30 could taper, either convergently or divergently in the downward direction. If the duct is convergent, its wall should be inclined to the central longitudinal axis through the nozzle by not more than about 15°. If the duct is divergent, the inclination should be not more than about 3½°.

As seen best in FIG. 4, the transition between the wall 32 of the inlet passage 26 and the constriction 28 is not sudden—although in other embodiments the transition could be in the form of a frusto-conical or right-angled step or shoulder. In the present embodiment, the transition is a smooth incurving wall section 33. Wall section 33 corresponds generally to the incurving discharge end configuration of a firehose nozzle. The section 33 can be of part-spherical contour.

Projecting inwardly from the wall 32 are a plurality of fins or ribs 35. Each rib is elongated in the direction of the said longitudinal axis and extends upwardly from constriction 28 part way along the length of the inlet passage 26. The top end 36 of each rib 35 forms a square step extending inwardly from wall 32 and presents a bluff obstruction to fluid flow down the inlet passage 26. The major portion of the inlet passage 26 is a plain cylindrical cavity extending upstream from the ribs 35 to the inlet opening 25.

In the embodiment of FIGS. 2 to 5, there are four ribs 35 and each is square or rectangular in transverse cross-section as seen in FIG. 3.

FIG. 6 shows a modification 20*a* of the nozzle 20 in which there are three wedge-shaped ribs 35. Otherwise, modification 20*a* has the same constructional features as the nozzle 20.

Ribs 35 are evenly spaced about the wall 32, at 90° or 120° intervals. The innermost, longitudinal faces of the ribs preferably lie in an imaginary cylindrical surface extending upwardly from the duct 30 and of the same diameter as the duct 30 and constriction 28.

The bottom end of the duct 30 is prone to erosion by molten metal leaving the nozzle 20. In time, therefore, the outlet opening 31 will tend to enlarge so that the bottom end of the duct becomes unevenly and divergently shaped. For best results in terms of producing a well-defined compact jet, such erosion should desirably be minimised. This can be done by generating a thin curtain of gas between the molten metal and the wall of the duct. Exemplary means for establishing such a curtain are illustrated in FIG. 7. In FIG. 7, 40 is a gas-permeable ring cemented into a recess 41 formed in the wall 42 of duct 30, and 43 is a gas conduit. Conduit 43 communicates with a manifold space 44 formed around the radially outermost surface of the ring 40. Compressed gas such as argon admitted to the space 44 permeates through ring 40 to produce an enveloping gas curtain about the molten metal stream. The gas is thought to protect wall 42 from erosion by preventing molten metal from coming into direct contact therewith and also helps to prevent build up of deposits in the duct due to bugging, snottering or skulling. Such deposits prove particularly troublesome when teeming aluminum-killed steels.

Figure 8:
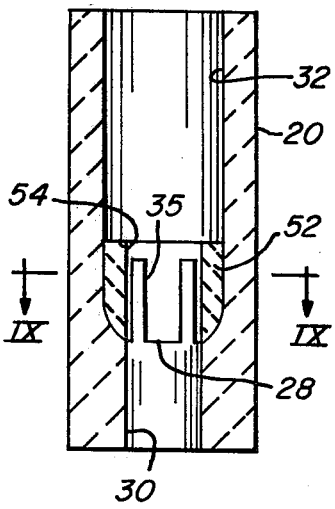
FIG. 8 is a longitudinal sectional view of a nozzle embodying another aspect of the invention.
Figure 9:
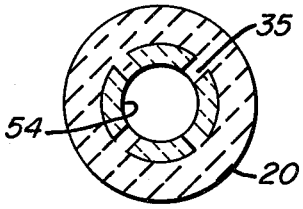
FIG. 9 is a cross-sectional view of the nozzle of FIG. 8 taken along line IX—IX.

Erosion is not essentially confined to the bottom end of the duct 30. It can be expected to occur in the region of the ribs 35. The production of well-defined jets can in practice be more difficult to achieve in the later rather than the early stages of a teem, when the metallostatic head in the ladle 1 is low. The nozzle 20 can therefore be adapted to protect the ribs 35 from premature erosion during early teeming stages. Such an arrangement is shown in FIGS. 8 and 9 in which the nozzle 20 is provided with a relatively soft, erodable nozzle liner 52 bonded chemically to the wall 32 so as to embed the ribs 35 therein. The liner can be generally cylindrical and can extend upwardly from the constriction 28 at least as far as, but preferably (as shown) beyond, the top ends of the ribs. The liner 52 is provided with a bore 54 equal in diameter to the duct 30 and with a square upper end forming a bluff step that separates the flow passage through the nozzle into a larger diameter upper section and a smaller diameter lower section. The liner is preferably made from an alumina-silica-carbon material. In use, the soft liner of the stepped nozzle will gradually wear away as teeming progresses and the ribs 35 will ultimately be exposed during the later teeming stages.

It is expected that a nozzle constructed as taught herein will operate very satisfactorily when steels for instance are teemed therethrough under varying throttling conditions. Water model tests show that superior results can be obtained with the present nozzle compared with conventional, plain bored nozzles.

When a sliding plate valve is in a flow-throttling setting as illustrated in FIG. 2, the metal flows into the nozzle asymmetrically. Thus, the incoming metal strikes one side of the inlet passage 26 and a recirculatory motion is set up in the fluid therein. See the flow pattern exemplified by the arrows in FIG. 2. It appears that the stepped ends of the ribs 35 serve to control the recirculatory motion and to prevent the recirculation zone from extending down to the constriction 28 and beyond into the duct 30. The constriction 28 appears to hinder flow through the nozzle 20 and to cause the inlet passage and orifices 23, 24 to be flooded with molten metal. Flooding plus back pressure upstream of the constriction have the effect of minimising or preventing air being sucked into the molten metal stream via the interface between the plates 20, 21.

The molten metal does not only recirculate as shown in FIG. 2. Some of the molten metal is likely to adhere to the side of the inlet passage and to travel down the side to the duct 30. Reference 50 in FIG. 5 indicates the region in which there is a net downward flow of metal. The molten metal is also subject to vorticity. It is found that two contrarotating vortices are set up within the inlet passage 26. These vortices are clearly apparent from FIG. 5. As the swirling molten metal stream encounters the ribs 35, the latter act to counteract swirling so that a substantially stable, smooth flow into the duct is produced. Further straightening and stabilizing of the flow occurs in the straight, parallel sided duct 30. The jet issuing from nozzle 20 is compact and straight, and a jet free from discernible break up at least as long as five times the issuing jet diameter is possible. An unbroken jet as long as ten to twenty times the said diameter can be produced even under unfavourable, severe throttling conditions. Such results cannot be equalled by conventional nozzles.

In a convention parallel-sided nozzle, a half-moon shaped jet develops inside the nozzle, the remainder of the nozzle bore being air filled, provided the valve is between 60% and 100% open. Negligible mixing of the jet with air occurs. If the valve is less than 60% open, the incoming liquid strikes the side of the bore with sufficient force to cause atomisation and intense mixing with air. A very unstable ill-defined jet issues from the nozzle.

In a firehose-type nozzle (not shown), a very stable jet is obtained provided the valve opening is not less than about 80%. 70% opening or less produces poor quality jets for the following reasons:

(1) a recirculation zone is set up inside the nozzle which may penetrate to the nozzle exit and may draw air into the nozzle with consequent severe mixing;

(2) the absence of any collimating parallel-sided terminal duct means that the jet tends to be deflected sideways to some extent; this can cause flaring; and (3) such a nozzle has no means for counteracting swirling which is particularly marked at low percentage openings. The resulting turbulence and mixing with air under these severe throttling conditions results in very unstable jets.

In a stepped nozzle, such as the present nozzle when adapted by means of the aforementioned protective liner, excellent jets are attainable for valve openings greater than 80%. For valve openings less than 70% or so, a large toroidal recirculation zone develops on account of impingement of the incoming liquid on one side of the nozzle internal wall. This is similar to the recirculation shown in FIG. 2. The recirculation zone stabilises the inflowing liquid and causes it to spread out to a large diameter mass substantially filling the inlet passage constituted by the larger diameter end of the nozzle. Below 60% to 70% valve opening, the liquid inside the stepped nozzle develops progressively intense vorticity as illustrated for the present nozzle in FIG. 5. The absence of anti-swirl ribs allows vorticity to remain in the jet leaving the nozzle so that jet stability is likely to deteriorate progressively as the percentage valve opening is reduced.

In the foregoing description, reference is made to percentage valve openings. These are linear percentages. When the orifices 23, 24 are exactly in register, the valve is 100% open. It is 0% open (i.e. closed) when the sliding plate 21 is moved to eliminate overlap between the orifices 23, 24. It is 50% open when the sliding plate is moved a distance equal to the radius of the orifice 23 therein from the 100% valve open setting of the slide plate.

Preferred dimensional relationships are now given merely by way of non-limitative example.

The ratio of length to diameter of the duct 30 is not less than 0.5 and desirably greater than 2.0.

The axial length of the ribs 35 is not less than the diameter of the duct and is desirably not less than twice the duct diameter.

The ratio of the diameter of the duct to the diameter of the inlet passage 26 is preferably not more than 0.8, for example 0.6 to 0.7.

The diameter of the duct can, for example, be of the order of 45 mm.

In principle, the ribs could be located at any position in the nozzle. For example, they could be inside the duct 30. However, it is important that they should not interfere with the recirculation zone and so, desirably, they should not project upwardly beyond the means which prevent the recirculatory currents passing the constriction, in the event that the said means is formed by some bluff obstruction other than the top ends of the ribs.

Although the nozzle described has an interior of circular cross-section, other cross-sections are possible, e.g. square.

Nozzles embodying the invention can take the form of detachable tips for fastening to the ends of e.g. straight-bored collector nozzle tubes.

What is claimed is:

1. A flow nozzle for use in the pouring of molten metal comprising:

(a) a hollow body having an inlet opening at one end, a discharge opening at the other end and a metal flow passage therebetween;

(b) a flow impeding constriction in said metal flow passage formed by a substantially annular shoulder about the interior of said hollow body defining an inlet section thereabove;

(c) means forming a duct between said flow impeding constriction and said discharge opening;

(d) a plurality of circumferentially spaced, elongated fins in the inlet section of said metal flow passage, said fins projecting inwardly from the wall of said body and extending generally parallel to the direction of metal flow through said passage; and (e) the upstream ends of said fins being longitudinally spaced from said inlet opening and forming abruptly bluff, inwardly projecting steps providing a substantially annular shoulder about the interior of said hollow body for obstructing the passage of recirculatory currents in the metal flow from entering said duct.

2. A flow nozzle as recited in claim 1 in which said duct has a length-to-diameter ratio not less than 0.5.

3. A flow nozzle as recited in claim 2 in which said duct has a length-to-diameter ratio greater than 2.

4. A flow nozzle as recited in claim 1 in which the wall of said duct is generally parallel to the axis thereof.

5. A flow nozzle as recited in claim 4 in which the wall of said duct is cylindrical.

6. A flow nozzle as recited in claim 1 in which said fins include a radially inner face formed substantially as a cylindrical surface of about the same diameter as said duct.

7. A flow nozzle as recited in claim 6 including means forming a lining of relatively softer and more erodable material embedding said fins.

8. A flow nozzle as recited in claim 7 in which said lining extends from said constriction to a level above the upstream ends of said fins defining a flow passage therealong of about the same diameter as that of said duct.

9. A flow nozzle as recited in claim 1 including means for injecting inert gas into said flow passage about the periphery of said duct.

10. A flow nozzle as recited in claim 1 including a gradual convergent section between said inlet passage and said duct.

11. A flow nozzle as recited in claim 10 in which said convergent section is a curvilinear surface.

12. A flow nozzle as recited in claim 11 in which said convergent section is generally spherically-formed.

13. A flow nozzle as recited in claim 1 in which said upstream ends of said fins have faces disposed substantially normal to the direction of flow through said passage.

* * * * *